US012098634B2

(12) United States Patent
Garrett et al.

(10) Patent No.: US 12,098,634 B2
(45) Date of Patent: Sep. 24, 2024

(54) CONCRETE CORING SYSTEM AND METHOD

(71) Applicants: Steve Garrett, Euless, TX (US); Gene Nicodemus, Pilot Point, TX (US)

(72) Inventors: Steve Garrett, Euless, TX (US); Gene Nicodemus, Pilot Point, TX (US)

( * ) Notice: Subject to any disclaimer, the term of this patent is extended or adjusted under 35 U.S.C. 154(b) by 0 days.

(21) Appl. No.: 18/116,169

(22) Filed: Mar. 1, 2023

(65) Prior Publication Data

US 2024/0247546 A1 Jul. 25, 2024

Related U.S. Application Data

(60) Provisional application No. 63/440,702, filed on Jan. 24, 2023.

(51) Int. Cl.
*E21B 7/02* (2006.01)

(52) U.S. Cl.
CPC ..... *E21B 7/028* (2013.01)

(58) Field of Classification Search
CPC ..... E21B 7/028
See application file for complete search history.

(56) References Cited

U.S. PATENT DOCUMENTS 4,099,579 A * 7/1978 Stormon ..... E21B 7/025 173/4
4,968,101 A * 11/1990 Bossow ..... E21B 10/485 404/90
10,279,508 B1 * 5/2019 Thornton ..... B23B 51/0426
2008/0179105 A1 * 7/2008 Duncan ..... E21B 10/02 175/420.1
2022/0154534 A1 * 5/2022 Schmitz ..... E21B 7/027

* cited by examiner

*Primary Examiner* — Taras P Bemko
(74) *Attorney, Agent, or Firm* — Chris Tanner; FYPA PLLC

(57) ABSTRACT

A system and method for achieving a coring process through construction surfaces is desired. The system can have hydraulic lines, a hydraulic motor, a water connection, a drillshaft, a cylindrical bit, a speed selector, a mast, a gearbox, a spacer, a water pump, a plurality of quick-connect ports, a rotating brace, and a water tank. During operation, the drillshaft will typically be parallel with the mast. The rotating brace enables a huge number of multi-directional drilling (coring) options. The system can cut into concrete, but can also cut metal with the right kind of cylindrical bit, and do so at a variety of angles. The system can also bore into metal, steel, most anything used in residential or commercial construction. The system can core (bore) straight up in the air, straight downward, as well as a variety of angles in-between.

17 Claims, 19 Drawing Sheets

(horizontal coring)

FIG. 7C (vertical coring)

(coring angled from vertical)

(coring angled from horizontal)

(possible locations of gearbox 136 and spacer 140)

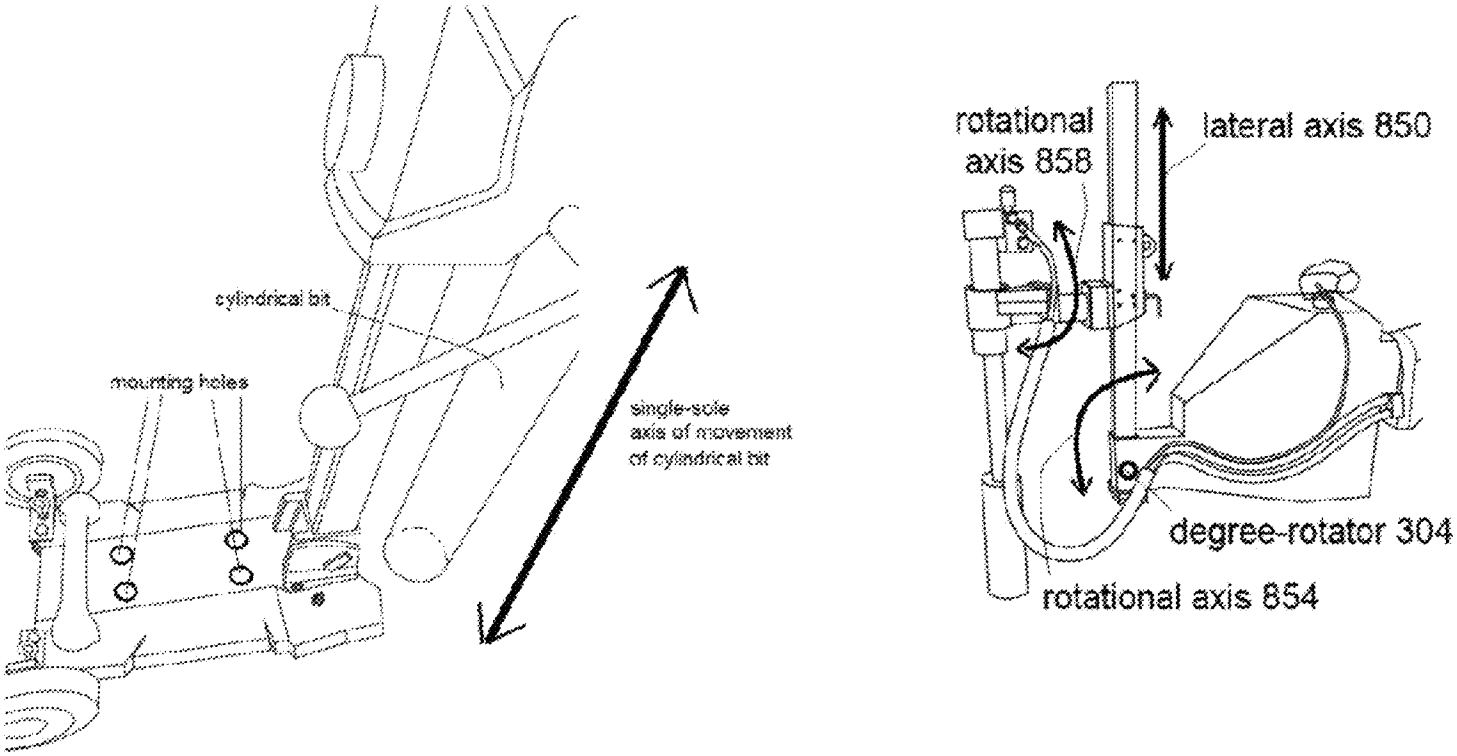
FIG. 10B (comparison with Prior Art)

CONCRETE CORING SYSTEM AND METHOD

There are some odd usages of language in the art of concrete and creating holes or apertures in a section of concrete. This process is sometimes referred to as drilling, but more likely to be referred to as "coring", where a cylindrical drill bit is spun into a concrete surface, and the core or the center of the concrete is eventually displaced and knocked out. The resulting hole or aperture can be quite useful.

This "coring" process is typically achieved by drilling use a "core bit", which is hollow and not shaped like a conventional drill bit. The core bit, or cylindrical bit, does not create a "hole" it instead creates a cylindrical cut into the concrete. This cylindrical cut has a "core" or center that is then knocked out or chiseled out in some way. The result is a carefully-sized hole in the concrete having a desired diameter and depth.

An additional semantic problem is that the word "core" can be either a noun or verb. The same problem exists with the word "coring". Further, there exists an element known as a "quick-connect". Within this disclosure, the expression "quick-connect" should also be read to include "quick-disconnect".

This disclosure will try to address language-usage using the simplest mechanisms possible, and try to avoid ambiguity.

BACKGROUND OF THE INVENTION

In working with concrete-based structures, it is sometimes necessary to carve out cylindrical holes (cores) from a section of concrete or other material. This comprises drilling a circular outline through the entire concrete, and then later poking out or breaking out the cylindrical core. In working with concrete structures, a conventional coring process goes straight up and down, but one has to mount the device doing the coring process. This means mounting the machine to the floor that is being "cored", including putting anchor bolts down and bolting it down to the floor. Alternately, if doing horizontal-coring into a wall that's straight up and down vertical, one must do the anchoring with horizontal anchor bolts.

There exist conventional devices coring that bore underground into dirt and softer compositions like that, but not into concrete. Also, these conventional devices may not produce an accurate core or hole. Also, the cylindrical bit can get overheated, so that a water-supply can be necessary, and this is not always available.

Further, conventional coring systems require anchoring to the ground in order for the coring device to work properly and not drift off in its own way. Conventional coring systems (core drills) may also require taking the shaft and bit away from the mast, flipping the whole thing over, and feeding it back down at the mast.

Consequently, an improved mechanism for achieving a coring process through construction surfaces is desired.

DETAILED DESCRIPTION OF THE DRAWINGS

FIGS. 7A-7B-7C-7D-7E show the embodiments in use at a variety of angles;

FIG. 10B shows a contrast in usability and flexibility of a Prior Art coring mechanism compared to the system;

DETAILED DESCRIPTION OF THE PREFERRED EMBODIMENTS

Figure 1:
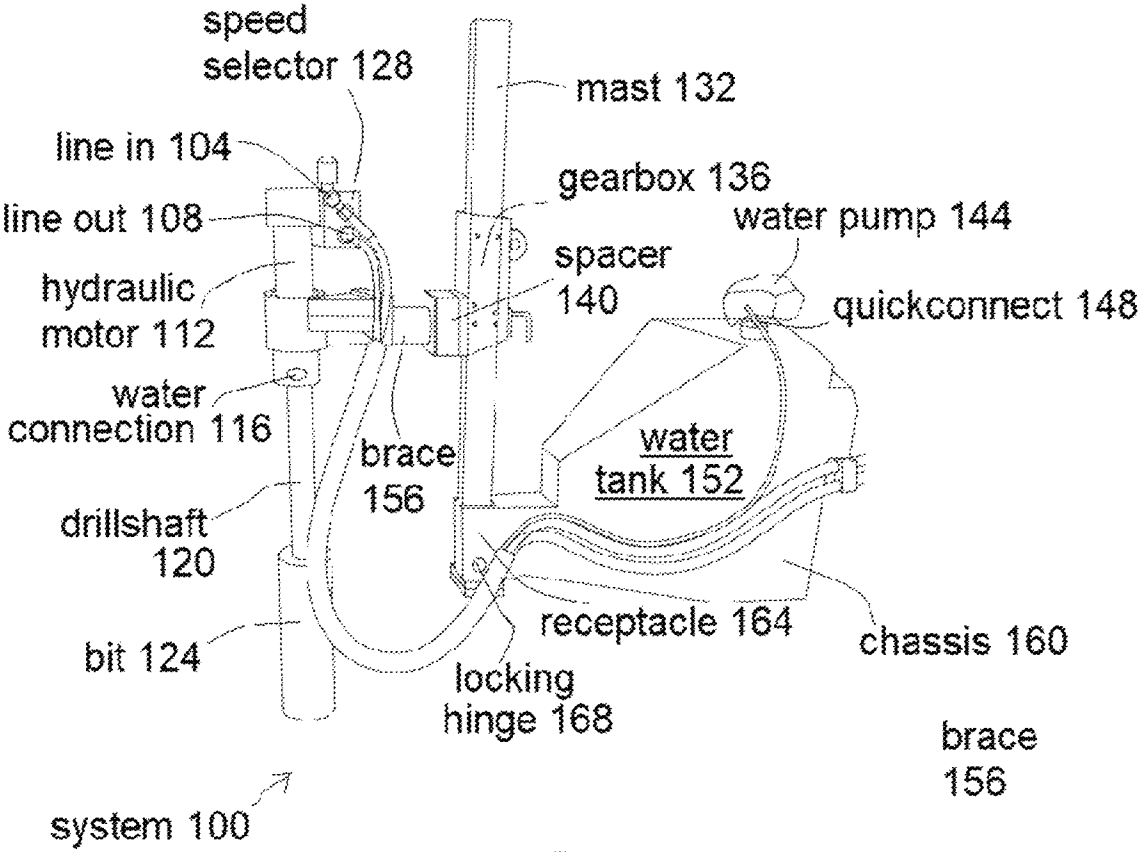
FIG. 1 shows a system for coring a concrete surface.

FIG. 1 shows a system 100 for coring a concrete surface, comprising hydraulic lines in 104 and out 108, a hydraulic motor 112, a water connection 116, a drillshaft 120, a cylindrical bit 124, a speed selector 128, a mast 132, a gearbox 136, a spacer 140, a water pump 144, a plurality of quick-connect ports 1481-*n* for various purposes, and a water tank 152. Some of the physical relationships of these various elements will be apparent from FIG. 1, although FIG. 1 is merely an example and should not be considered limiting. One important consideration not obvious from FIG. 1 is that the drillshaft 120 will, during operation of the system 100, typically be parallel with the mast 132. This simplifies manufacturing and transport for the system 100, especially the rotating brace 156.

The speed selector 128 controls the speed of rotation of the drillshaft 120 and cylindrical bit 124. The drillshaft 120 and hydraulic motor 112 are reversible, and have a transmission and strain detection modules, including wireless connection Bluetooth for notifying users of various events e.g. getting stuck, overheating, or resolving other problems that require manual intervention.

The plurality of quick-connect ports 1481-*n* are located at strategic points within the system 100. The quick-connect ports 1481-*n* can be employed if advantageous to use hydraulic power, air, or water from an external source outside the system 100. This way, the system 100 can provide self-air and self-water, where suitable. Within this disclosure, the expression "quick-connect" should also be read to include "quick-disconnect".

Specifically, the water tank 152 can optionally have the water pump 144 built into it, thus comprising a self-contained water supply. The water tank 152 can also be either permanently affixed to a frame of the system 100, or be removable. For convenience, various drawings show the water pump 144 external to a chassis 160 for the water tank 152, but optimally the water pump 144 would be concealed and protected within the chassis 160. However, in a streamlined version of the system 100, an external water supply can also be accommodated as will be shown in more detail herein. Thus, depending on usage and distance requirements, the water tank 152 might be optional. The optional battery pack 144 allows the water pump to work by itself without requiring power from the skid-steer 604.

Another embodiment exists with a smaller chassis without the water tank 152, or existing chassis with water tank 152 removable. Regarding the water tank 152, the chassis 160 could be built from plastic or could be built from stainless steel, for durability. The water tank 152 can come out (removable) and it can be replaced if broken.

The water pump 144 is shown visible in FIG. 1 for clarity, but typically the water pump 144 will not be exposed outside the tank 152. One can locate it down inside the chassis 160 but of course not inside the water-tank 152 itself. Or use a flush mount, but concealed down within the chassis 160. Suffice to say, within the embodiments herein, the water pump 144 will be protected in a variety of ways.

The rotating brace 156 is an important feature, and enables a huge number of multi-directional drilling (coring) options. FIGS. 7A-7B-7C-7D-7E emphasize this feature. In operation, the system 100 can cut into concrete, but can also cut metal with the right kind of cylindrical bit 124, and do so at a variety of angles (see FIGS. 7A thru 7E). The system 100 can also bore into metal, steel, most anything used in residential or commercial construction. As will be shown in more detail herein, the system 100 can core (bore) straight up in the air, straight downward, as well as a variety of angles in-between.

Figure 2:
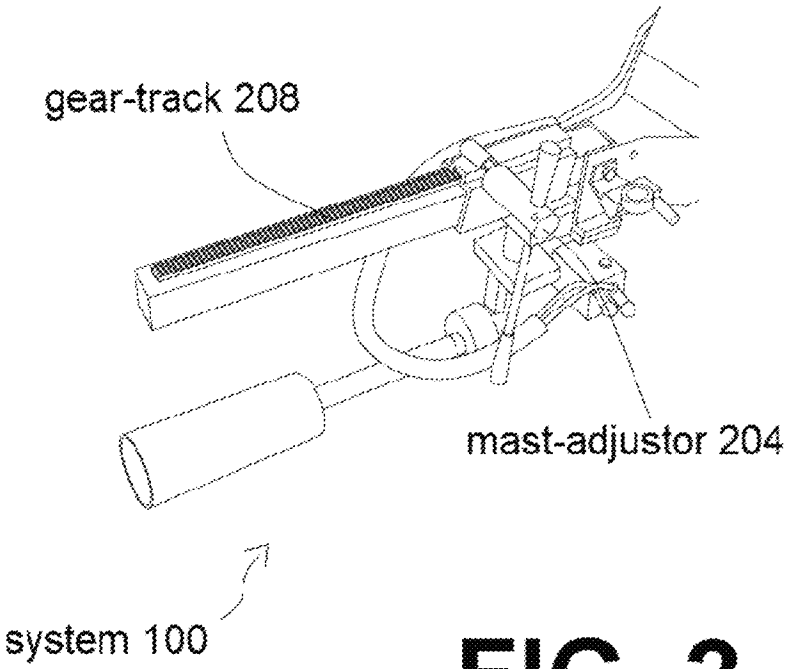
FIG. 2 shows a mast-adjustor.

FIG. 2 shows the mast-adjustor 204, which advances the gearbox 136 along a gear-track 208 located within a longitudinal axis of the mast 132. In operating and positioning the system 100, it is advantageous to be able to move the gearbox 136 up and down the mast 132, to more effectively position the drillshaft 120. The mast 132 and the drillshaft 120 work in close proximity, connected by the rotating brace 156 which assists with positioning.

Figure 3:
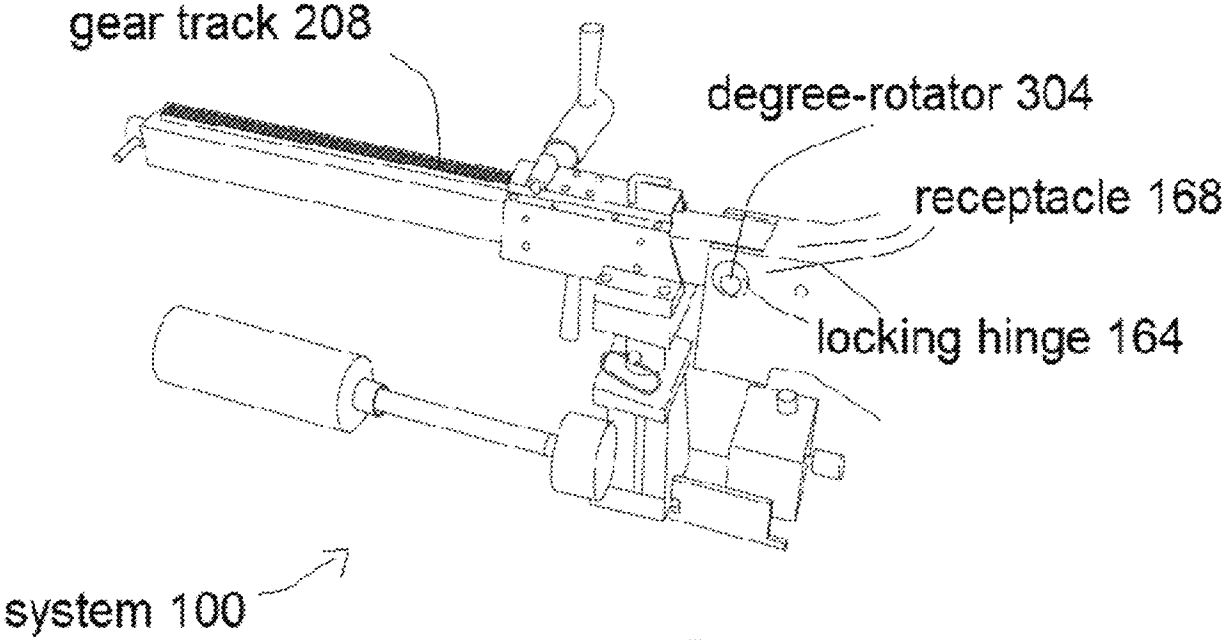
FIG. 3 shows a degree-rotator 304 which allows the mast and hence the system to pivot.

FIG. 3 shows a degree-rotator 304 which allows the mast 132 and hence the system 100 to pivot at e.g. 22, 45, or 90 degrees, but also is configurable for other degree-settings. Various features prevents the degree-rotator 304 from slipping, and ensures staying in position.

The degree-rotator 304 and locking hinge 164 can comprise various mechanisms of latching, gearing mechanisms, gear drives and hydraulic gear drives. It is possible to make tolerance as tight as needed, using e.g. a gear drive. One can make the tolerances lesser by implementing a hydraulic gear or a crank gear or other resource. A receptacle 168 exists to help the mast 132 stay in place during transport. The degree-rotator 304 and locking hinge 164 sit inside the protective receptable 168 and help the mast 132 lock into a selected position.

Figure 8A:
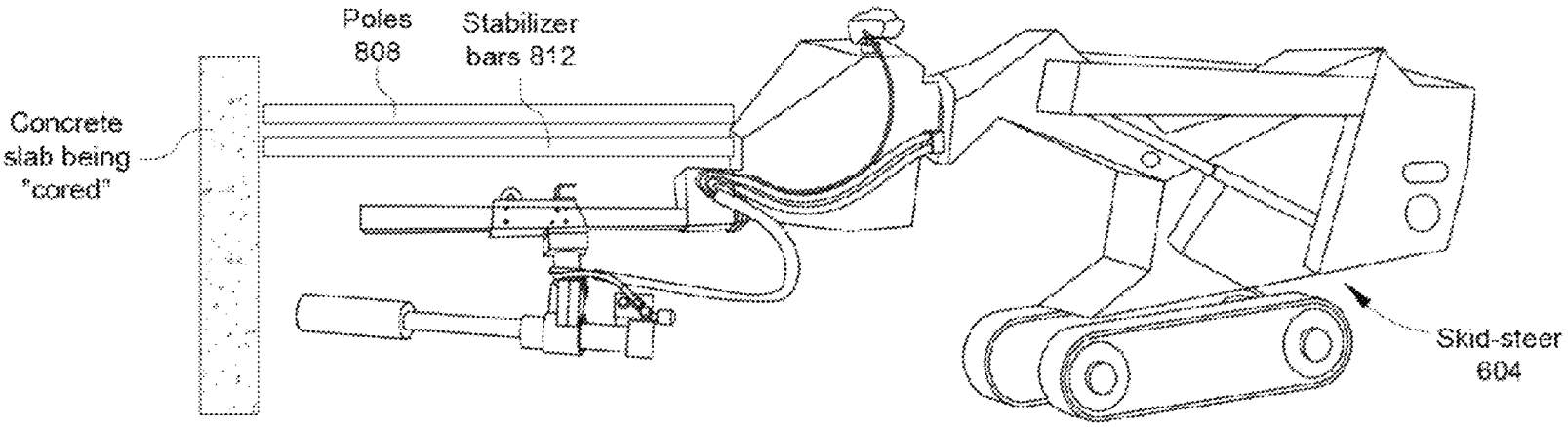
FIG. 8A shows a horizontal context for the system.

The degree-rotator 304 allows the operator to rotate the mast 132 up to 180 degrees around the axis 854 (see FIG. 8D) thereby allowing for horizontal and overhead drilling. The specific type of degree-rotator 304 shown in FIG. 3 is for example only, and thus should not be considered limiting. The degree-rotator 304 and locking hinge 164 can be motorized and have graduated gear-tracking for precision settings.

In the concrete coring industry, the ability to pivot at e.g. 22, 45, or 90 degrees is, by itself, an advantage. However, the degree-rotator 304 permits even finer granularity of adjustments. Although the drawings herein do not show every position, that should not be considered limiting.

Figure 8B:
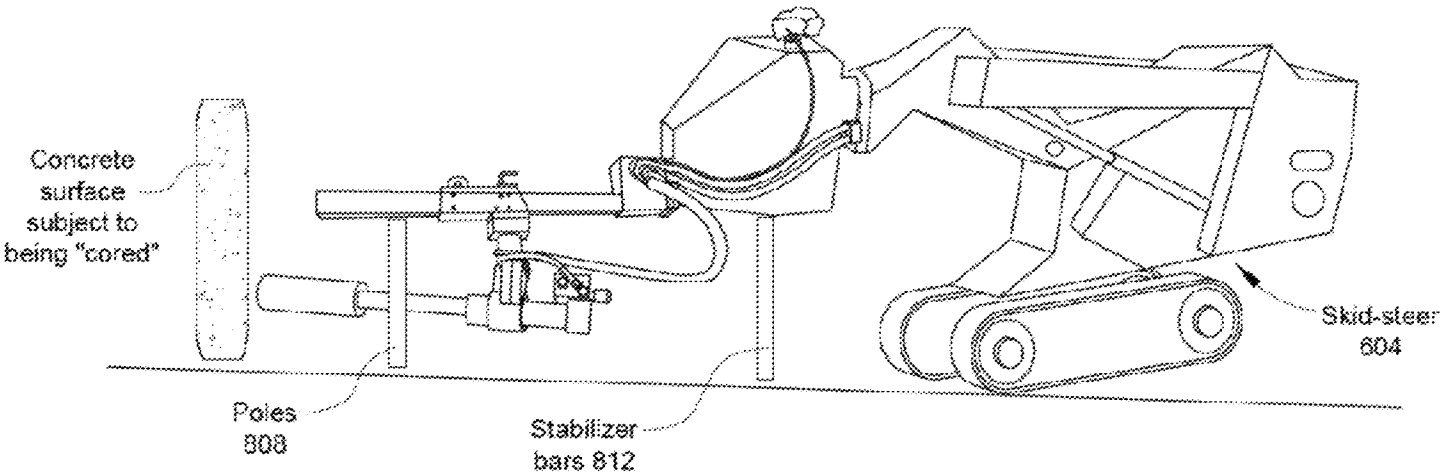
FIG. 8B shows a vertical context for the system.

FIG. 8B shows a linear axis 850 and two separate rotational axes 854 and 858. The combination of a linear axis and two separate rotational axes ensure that the system 100 provides a variety of configurable options, angles, and positions for successful coring tasks.

The system 100 further comprises an electric power-cell that reduces need for hydraulic power from skid-steer 604.

Figure 10A:
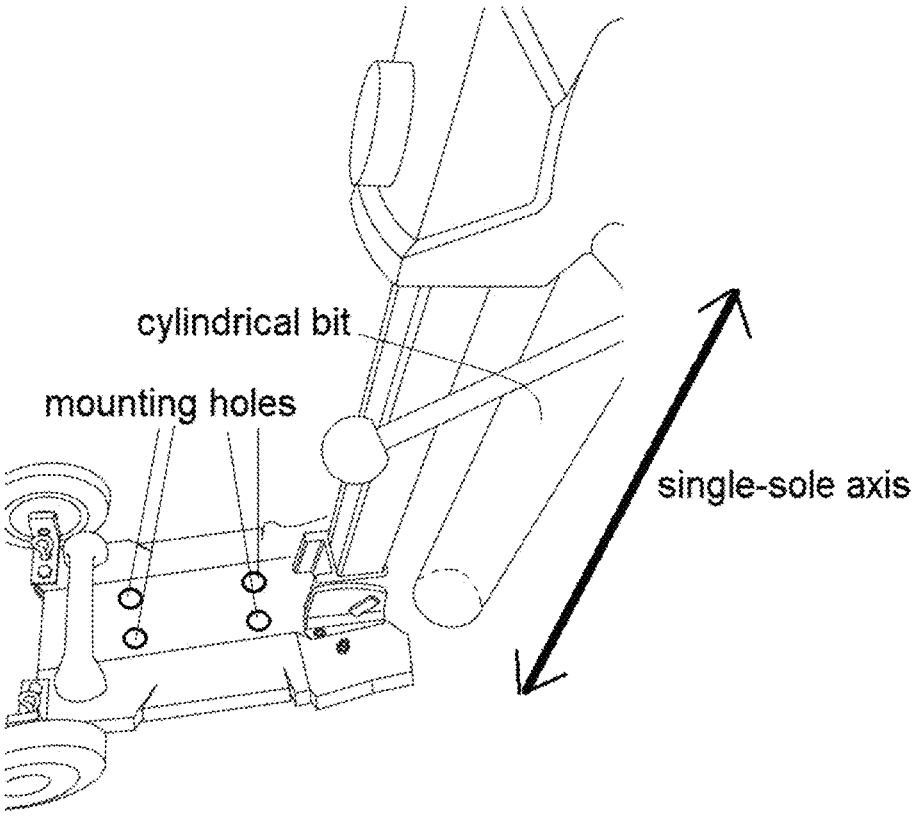
FIG. 10A (Prior Art)
FIG. 10A (Prior Art) shows a conventional coring mechanism.

The degree-rotator 304 is one of numerous items that distinguishes the system 100. The degree-rotator 304 provides an ability to lay down the mast 132 to a horizontal position and rotate the head 180 degrees. Even if any conventional version (e.g. FIG. 10A) had a mast 132 that would pivot down horizontally, users would still have to remove the drill head from such a mast and rotate it by hand and then re-install it on that mast. That is time-consuming and thus non-advantageous. FIG. 10A (Prior Art) shows such a conventional coring mechanism.

Figure 4:
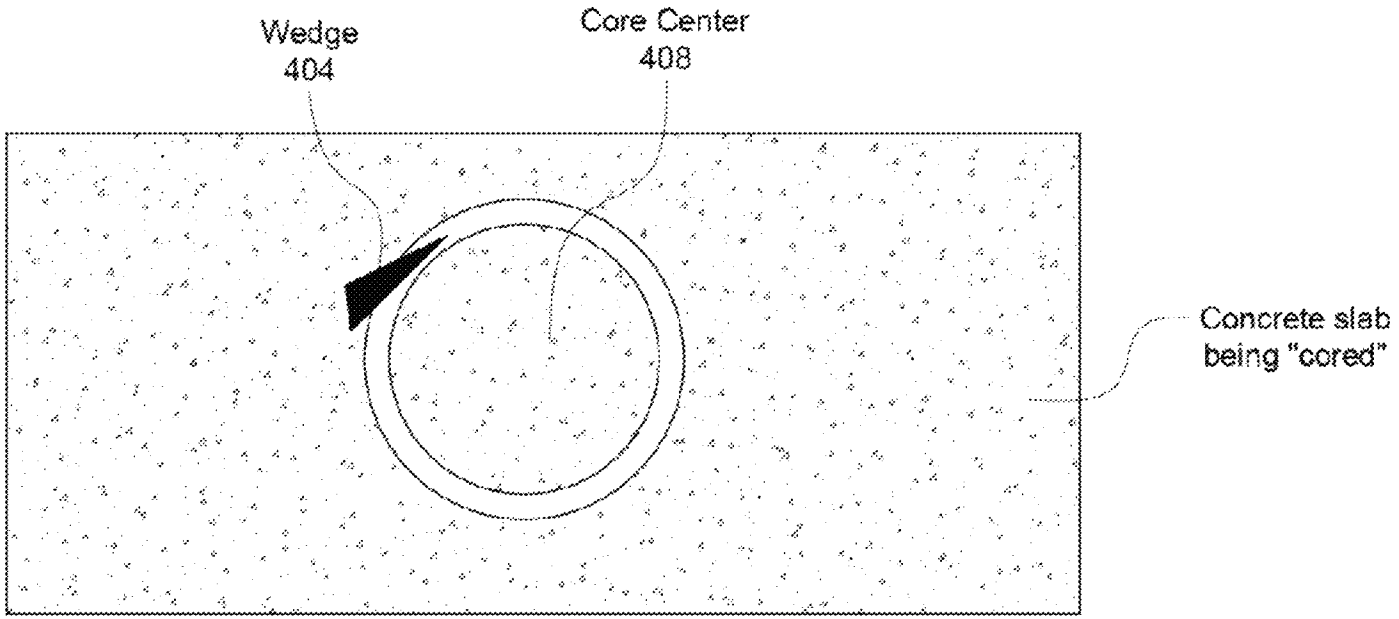
FIG. 4 shows a scenario in which a wedge is used.

FIG. 4 shows a scenario in which a user may be coring thicker concrete using the system 100. At that time, it is possible to drill in 13", remove the cylindrical bit 124 from the hole, and then drive a wedge 404 (FIG. 4) in between the two pieces being cored. This should separate the core center 408 so that a user can then crack and remove that core center 408. This will allow using the system 100 to core into that same hole for another full 13", if required.

Figure 5A:
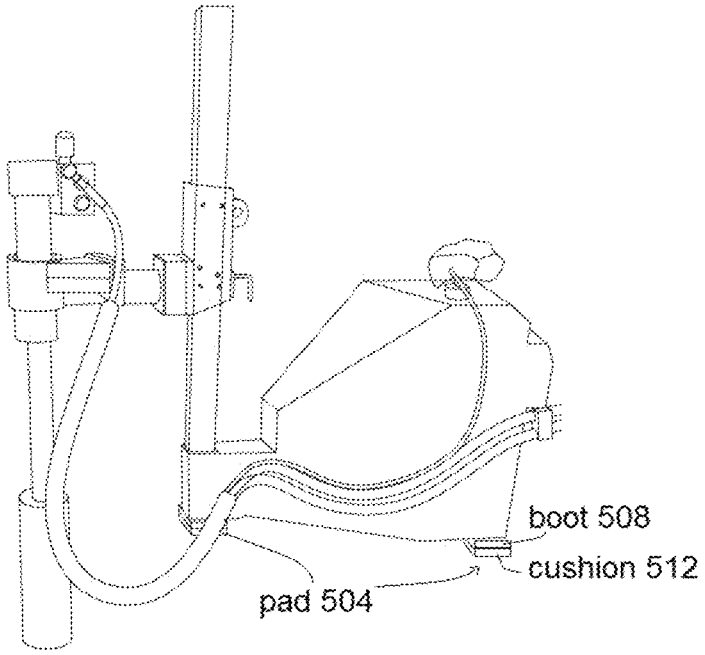
FIGS. 5A-5B-5C shows a three-pad landing arrangement.
Figure 5B:
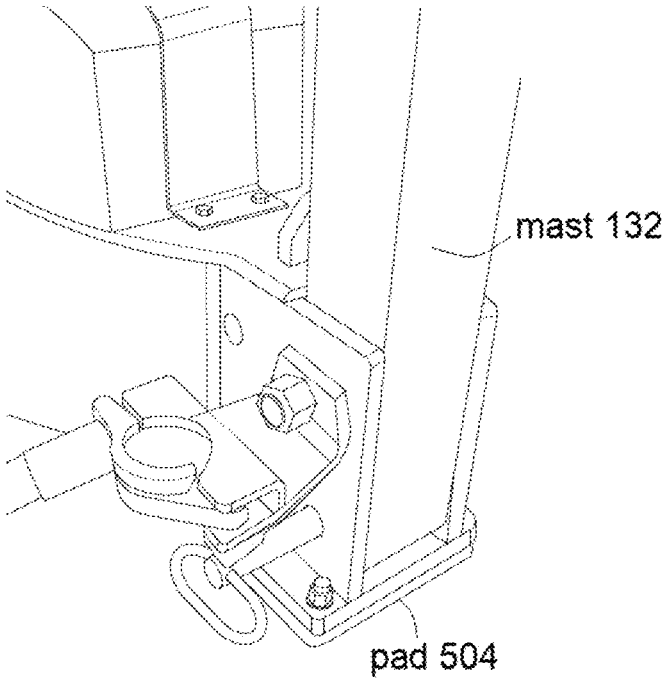
Figure 5C:
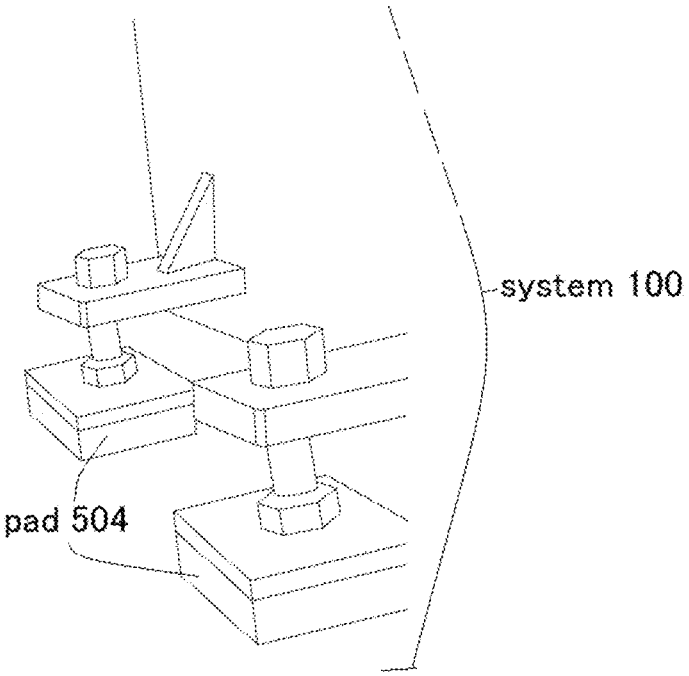

FIGS. 5A-5B-5C shows a three-pad landing arrangement, where each of the pads 504 comprise a boot 508 and a cushion 512. When the system 100 has been properly located and is stationary, it can be lowered onto the ground with all its weight concentrated on the pads 504. Using the three pads 504, it is not necessary to anchor any portion of the system 100 to anything. This is for at least the reason that the system 100 is sufficiently heavy to not be prone to movement, especially when the water tank 152 is full, but also in those embodiments where the water tank 152 is removed or empty. The boots 508 can be adjusted up and down. The rubber cushions 512 protect a finished floor, and prevent marring of any surface such as linoleum or tile of a home or driveway. Thus, using the three-pad arrangement, a user of the system 100 can work on finished floors and not harm them, and is thus not confined only to outside surfaces.

Figure 6:
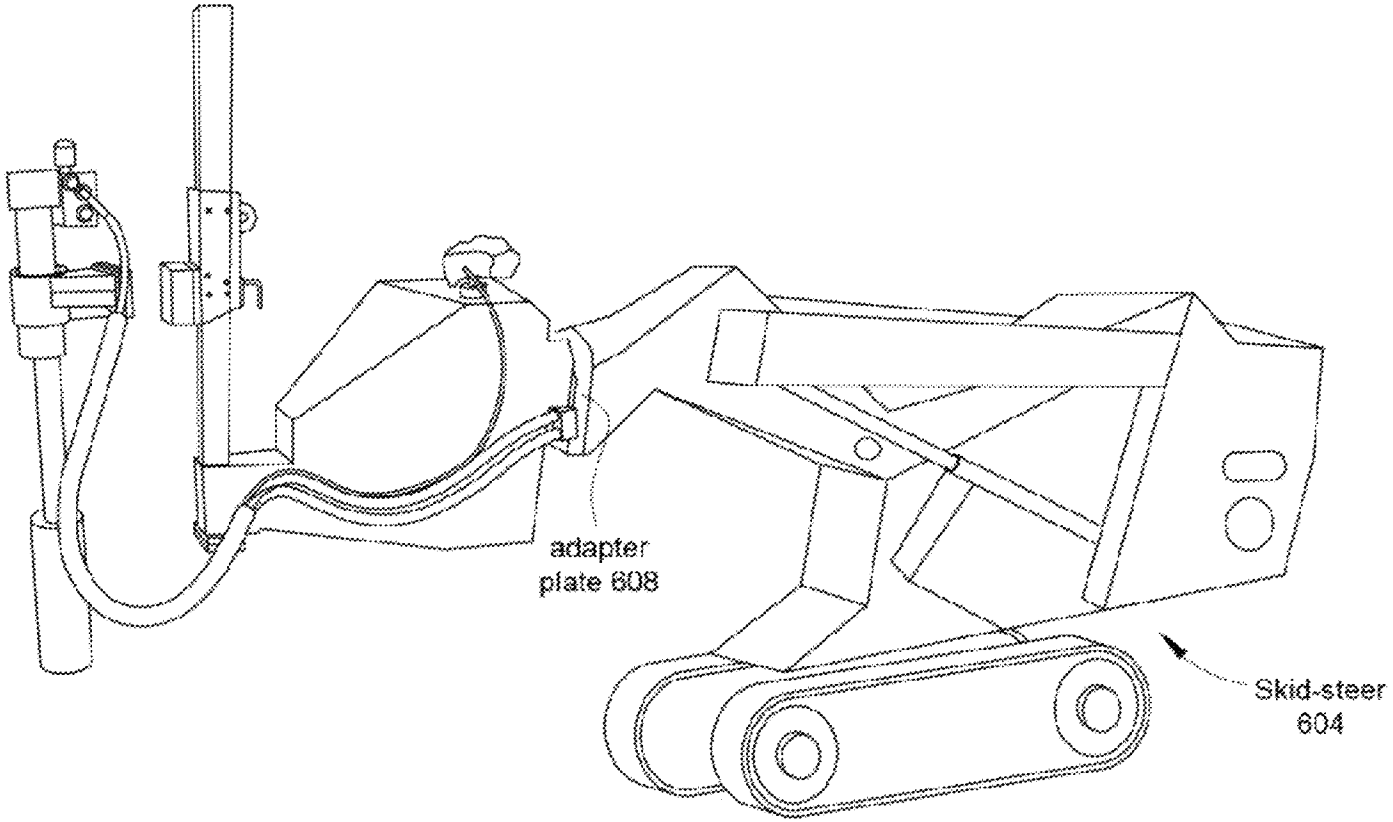
FIG. 6 shows a skid-steer used to transport the system.
Figure 7A:
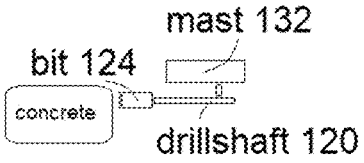
Figure 7B:
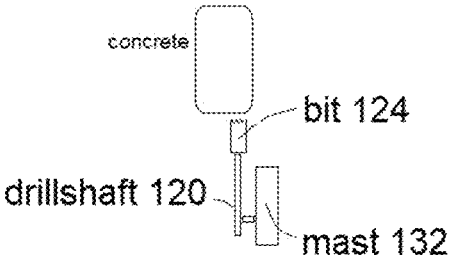
Figure 7B:
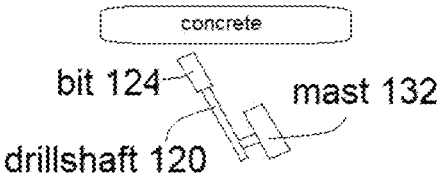
Figure 7D:
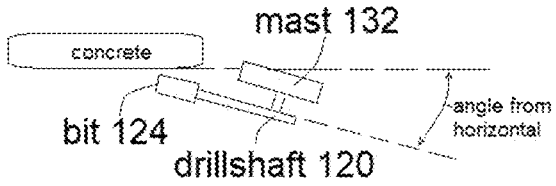
Figure 7E:
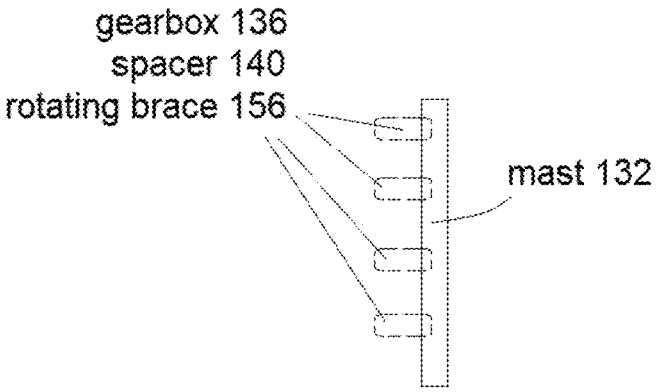

FIG. 6 shows a larger view of the system 100, in which a skid-steer 604 is used to transport the system 100, and also to provide hydraulic power to the hydraulic lines in 104 and out 108 which in turn provide power to the system 100 during use.

Regarding the relationship between the skid-steer 604 and the system 100, the attachment plate 608 is standard for almost all usages of the system 100. As suggested within FIG. 6, during storage or transport (non-use states), the mast 132 is put into a vertical-only position using the degree-rotator 304 and then stored or moved. During use, the mast 132 can be put into a variety of positions, partly by adjusting the rotator 304.

The system 100 shown in FIGS. 1-6 is a smaller version, but the embodiments herein should not be considered as limited exclusively thereto. Another larger skid-steer 604 can be part of a larger version of the system 100.

Context and Usage

Most concrete coring is done on concrete that is 4" to 12" deep. To accommodate this, the cylindrical bit 124 can be 14" in length and cuts a bore (core) up to 13" before bottoming out. The cylindrical holes in concrete that are created by the system 100 might be filled with e.g. fence-posts, round studs or framing for a building-structure, pipe, PVC, plumbing, drains, or electrical wiring (using e.g. conduit or panduit). In a preferred embodiment, the usage will be for electrical or plumbing that requires a hole through a concrete slab. However, other usages exist, such that the embodiment herein should not be considered limiting.

Coring on an angle is used when access to an opposite side of a concrete slab may not be available. Further, conventional coring mechanisms (e.g. FIG. 10A) are typically limited to a 90-degree angle. Accordingly, one example where the system 100 provides value might be for passing a metal beam below a floor, but where it was not possible to gain access to the top of the hole using a conventional 90-degree coring system. FIG. 10B shows a contrast in usability and flexibility of a Prior Art coring mechanism compared to the system 100.

Another example usage might be where the concrete is directly above a worker, such as in concrete parking garages. These are typically built with no access holes for plumbing or electrical, and have very low clearance heights. To address this, the system 100 has substantial overhead ability which gives a contractor a huge advantage for finding access to core a hole without having to drill and mount anything to the overhead surface. Further, having a coring (cylinder) removed typically does not weaken a concrete structure. Round holes are extremely strong and when done correctly, can actually strengthen the surface being cored.

FIGS. 7A-7B-7C-7D-7E show various examples of angled coring, and example positions of drillshaft 120, cylindrical bit 124, and mast 132 relative to a concrete section being cored. From FIGS. 7A-7E it is apparent that the system 100 can be arranged in a variety of helpful and advantageous positions.

In an embodiment, the cylindrical bit 124 is diamond impregnated on its teeth 125 at the bottom of the cylindrical bit 124. These teeth 125 make the cylindrical bit 124 capable of drilling through just about anything, including concrete and also through any rebar used in forming the concrete structure.

The system 100 can be loaded into the bed of a truck. Contractors can rotate the cylindrical bit 124 up off the ground, and then move it into the bed of the truck. Or they can hook the cylindrical bit 124 around at some other convenient angle, and set it back down in the bed of the truck.

As stated, a conventional coring mechanism is shown in FIG. 10A (Prior Art). Within this mechanism, the core bit has no rotational capability, and only moves only a very short vertical axis. The four bolt-holes are for when the conventional coring mechanism needs to be mounted.

If a contractor wants to drill horizontally, that's where conventional coring devices just can't go, not without complex mounting. Instead, it is necessary to bolt it up to the wall and pull horizontal and then cover the unsightly holes drilled after completion. Perhaps two hours labor is consumed. The embodiments herein completely eliminate that two hours.

Electronics and Sensors

An embodiment adds Bluetooth and mobile app to the hydraulic motor 112, to the water tank 152 and potentially other elements, to provide e.g. heat detection and/or other mechanical failure detection. This arrangement can prevent problems and breakaways, but notifying a user the motor 112 or other part of the system 100 is overheating or straining.

Also a lower-level version of the mobile app exists for users doing simpler tasks that do not want or do not need complex notification-GUIs. Thus the mobile app is configurable, not merely a "one GUI fits all" type of user-interface. The system 100 should be simple to use, where many tasks do not require high expertise. The GUI for that version might be a more simplified and limited scope GUI. However, other more advanced usages may have a completely different set of GUI menus.

It is possible to connect a Bluetooth setup\sensor to the system 100 for detecting passage of fluids using e.g. a Bernoulli sensor, whether hydraulic fluid or water fluid.

An embodiment exists in which an owner can be always notified of exact location of a system 100. If somebody steals it or removes it, such an event is recoverable. Anytime the system 100 is moving, its GPS can be active and notifying an on-site or remote user of the position of the system 100, using the mobile app.

More and more construction managers are offsite; thus they are unsure if their employees are screwing off or not, and may need some kind of productivity measurement. One question might be whether the system 100 actively touching concrete in some way, preferably the cylindrical bit 124. Such an embodiment could be used to determine that employees are not cheating. Using the mobile app within the system 100, construction site managers may sit in the office and track all the equipment out there in the site, even with supervisor not present and they can assess what the workers are doing even from hundreds of miles away.

The mobile app can display whether the hydraulic motor 112 is going forward or reverse by a Bluetooth arrangement attached thereto, which is polled by the mobile app. The mobile app can notify someone of problems e.g. "yes, it's going forward" or "yes, it's going in reverse", or other activity. The boss at the office knows they're operating. Report it all to a GUI on the mobile app.

Figure 11:
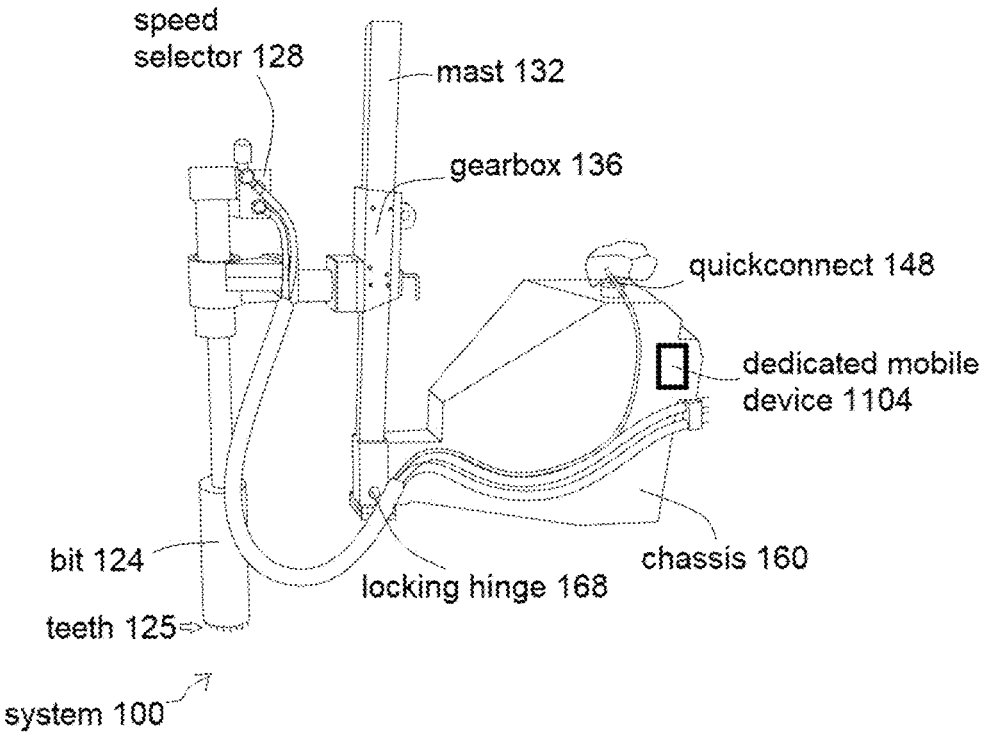
FIG. 11 shows a dedicated mobile device native to the system.

As shown in FIG. 11, a dedicated mobile device 1104 native to the system 100 is also contemplated. Assume that a person operating the system 100 needs to be notified "hey, you're doing something bad, something is going wrong here". That operator might say "oh yeah, I did run out of water, good call", or some other operator-error. As shown in FIG. 11, this dedicated, non-personal mobile device 1104 could be mounted on the chassis 160, and not the worker's personal mobile device. Instead, the mobile device 1104 acts as a dedicated (permanent) monitor of the system 100, by leveraging the mobile device 1104 as a convenient front-end dashboard for the person directly operating the system 100 on-site.

Another enhancement is a mounted guidance laser. Such a laser emerges from the system 100, and helps guide a user to exactly where to locate the cylindrical bit 124. The laser also provides a plumb-bob service, showing relationship to earth parallel with the surface of the earth, or perpendicular. This feature can insure the core-task achieves true verticality, true horizontality, or provide authentication in case on uneven ground or angled surfaces, etc.

In some cases, a user might ignore the fact that a coring might not be a hundred percent horizontal. If a user is pulling the system 100 up to a target, let's say they marked the spot on the wall with a pencil. Using the laser, one can drive the system 100 where that mark is located. That user can get closer to the target being cored, not going back and forth, not struggling and shifting the entire heavy machine around. The siting/locating can maybe work using sight-lines e.g. ordinary eyesight. But such eyeball-siting could take longer, or it could be slightly off.

Stabilizers and Mounting Brackets

Another feature is shown in FIG. 8B, which depicts jack bolts 808 connected to a base of the system 100, one example being at the pads 504 since they are known to be suitable for weight-bearing tasks. These jack bolts 808 to help "level" (verb) the system 100.

A user can bolt down the system 100 to be assured of anchoring to a specific horizontal level. That is, be assured it's level enough to do a hole concrete. When users set down the system 100 on the three pads 504, the system 100 becomes ready to start coring.

Moving on to building parking garages, when they pour the concrete for those garages, they might not create access holes for electrical ports. However, later these might be considered valuable. So let's say they need a hundred holes cored out. A conventional system (FIG. 10A) would need one of those be bolted down to and a lot slower. The system 100 requires none of the typical mounting and unmounting associated with convention coring mechanisms (e.g. FIG. 10).

Using mounting brackets on the body of the system 100, it is possible to locate poles 808 to hold the system 100 and prevent shifting around and moving. FIG. 8B shows a vertical context. FIG. 8A shows a horizontal context, locating poles to where they're coming up to the vertical wall (concrete surface which will soon experience coring). Setting these up where they have to get a little bit of horizontal pressure against a surface, where the system 100 doesn't move back and forth.

Figure 8C:
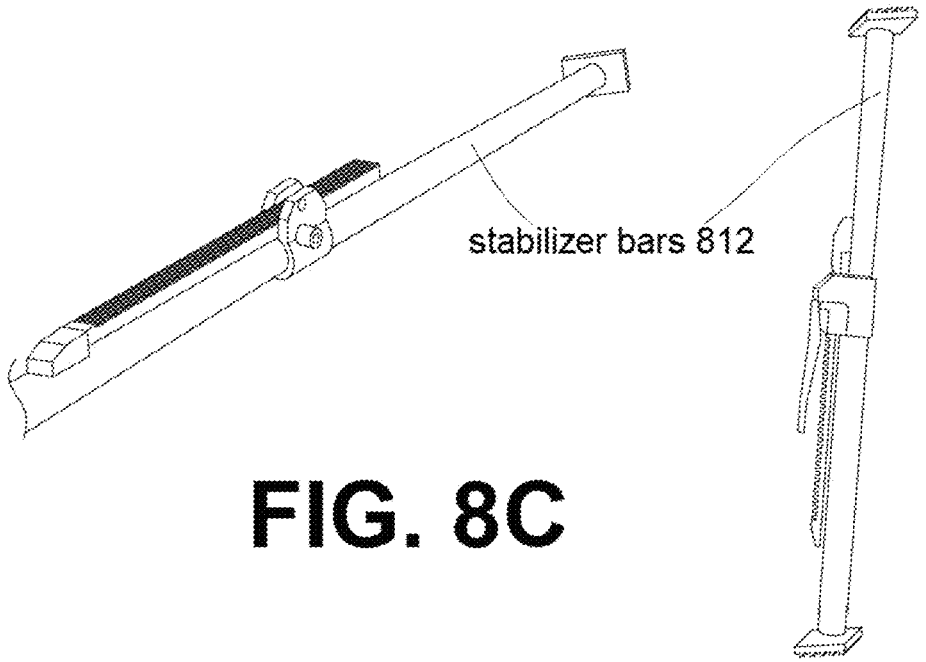
FIG. 8C shows stabilizer bars having ratchet capability.
Figure 8D:
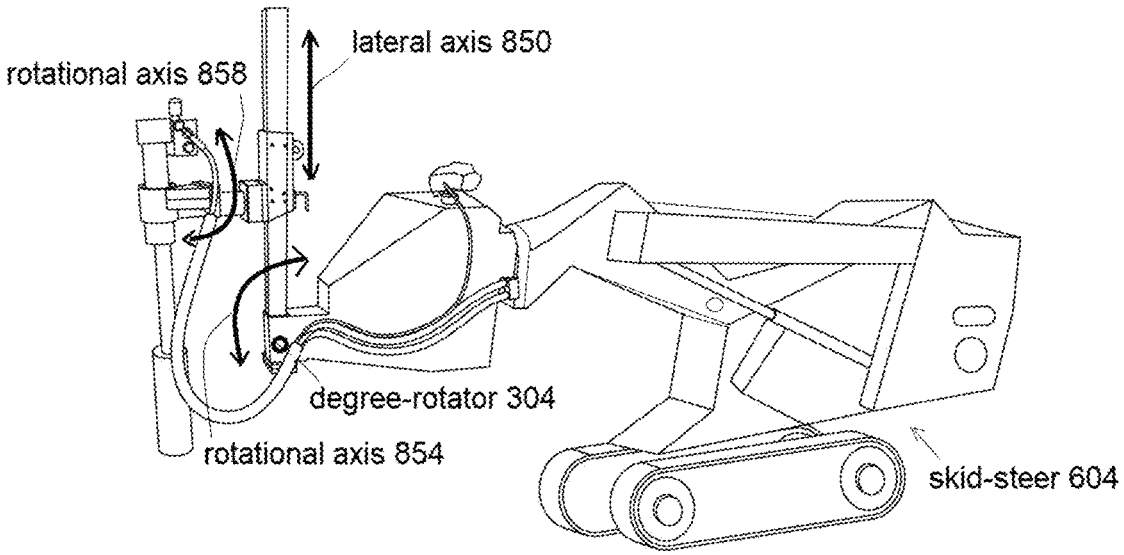
FIG. 8D shows a linear axis and two separate rotational axes.

FIG. 8C shows stabilizer bars 812 having ratchet capability. As shown in FIG. 8B, it is possible to locate stabilizer bars 812 at points on the chassis where bars that go down on the ground for if wishing for a little higher, instead of dropping it down solely on the pads 504.

The above discussed stabilizer bars 812 are shown in a vertical context. However, it is possible to use stabilizer bars 812 in horizontal context also. As shown in FIG. 8A, these stabilizer bars 812 extend to the wall and ratchet some minimal pressure, and then that way it holds the system 100 from even trying to move.

As shown in FIG. 8C, there exist adjustable stabilizers 812, that can ratchet upward or downward. Users will ratchet these to be bigger, smaller, according to needs of space and stability and where the system 100 and the cylindrical bit 124 is located in relation to the concrete surface subject to coring. If the system 100 is sitting up or going into a wall, mount it into the wall and then you extend it out.

As stated, FIG. 8A shows the stabilizer bars 812 which brace against the wall itself to give good stabilization. Pull this up, ratchet them, and lock the system 100 like an emergency brake, use that to stabilize the system 100 against any vertical concrete wall.

Multi-Step Coring

A standard cylindrical bit 124 is 13 inches long. As such, one can only drill in 13 inches and then be bottomed out. Now let's say a 24 inch section of concrete is needed to be cored out. If so, drill it out, but that centerpiece the "core" (noun) is still in there. If so, using the wedge 404 (FIG. 4), just hit that centerpiece (core) with a hammer and the core will break off in there. Then pull it out and one can drill in again, re-apply the cylindrical bit 124, and keep coring.

Separated Operation

Figure 9:
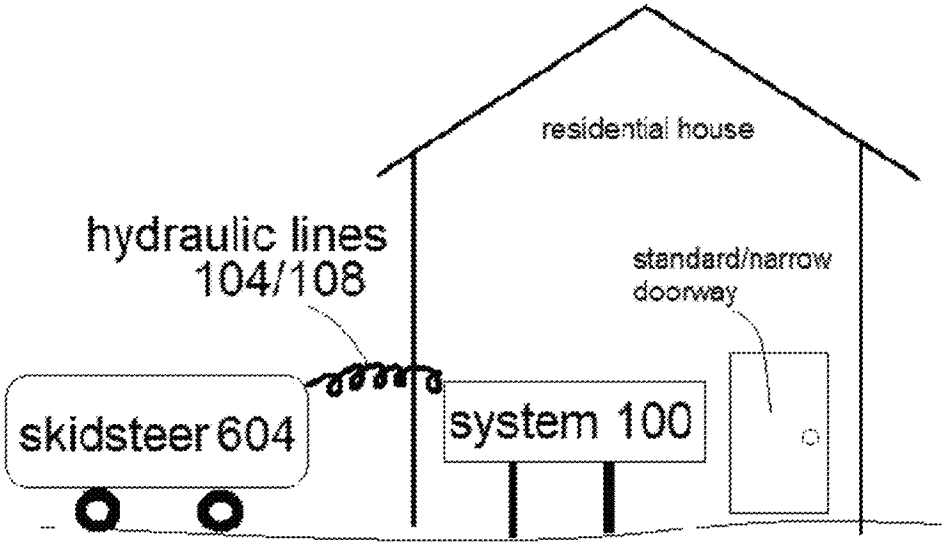
FIG. 9 shows the skid-steer staying outside a house but where the embodiments are employed within the house.

Another convenient feature of the system 100 is shown in FIG. 9, in which is separated operation occurs, where the skid-steer 604 stays outside a building but the system 100 is moved inside of the building or structure. The hose-connections can extend to e.g. 100 feet. In the battery embodiment, some hydraulics hoses 104/108 are not needed.

Let's assume that a residential basement needs a wood burning heater which means an exit port must be cored from existing concrete. A skid-steer 604 can't fit in a basement space. Plus, the exit hole make a mess everywhere. Further, this task will need water to manage the nasty dust created by indoor-usage of the system 100 and especially the cylindrical bit 124. The FIG. 9 arrangement could resolve all this.

Setting aside basements, now consider a narrow hallway. This is why its convenient to rotate the drillshaft 120. Now consider going into a school hallway; one can't turn it around 90 degrees in a school hallway. Instead, pivot at the rotating brace 156 and then extend the hydraulic hoses 104/108.

Typically, the system 100 will be heavy and difficult to move by hand, hence the skid-steer 604. However, including cranks with wheels would be helpful, where users could crank up and wheel the system 100 around. Assume there was a job in a residential house. Could go inside, push the system 100 through the door, get it in the house and set it up and be ready to do coring inside. No contractor can get a skid-steer inside a house. Instead, leave the skid-steer 604 outside, and use extension-hydraulic hoses 104/108 and pass them from outside to inside as shown in FIG. 9.

It is also possible to roll in the system 100 e.g. on a dolly and set it down on the pads 504 and bring up a couple extension hoses sitting outside like in FIG. 9. The attachment plate 608 on the system 100 would be employed. It just has four jacks that have wheels and instead of moving the skid-steer 604, there would be 50 foot hoses, 100 foot. In other words, the skid-steer 604 is helpful, but still optional for operation of the system 100.

It is important to note that at first, it may seem like the physical force-vectors on the mast 132 and drill-shaft 120 would be enormous. But they are not. The actual drilling, the force is provided by the hydraulic motor 112 and the cylindrical bit 124 such that the mechanical forces on the system 100 are minimal. This is something many even knowledgeable concrete workers are not aware of. The embodiments herein overcome this fallacy by properly managing weight, by being adaptable, being customizable, and by utilizing modernized construction components to that did not previously exist even 10 years ago.

Figure 12:
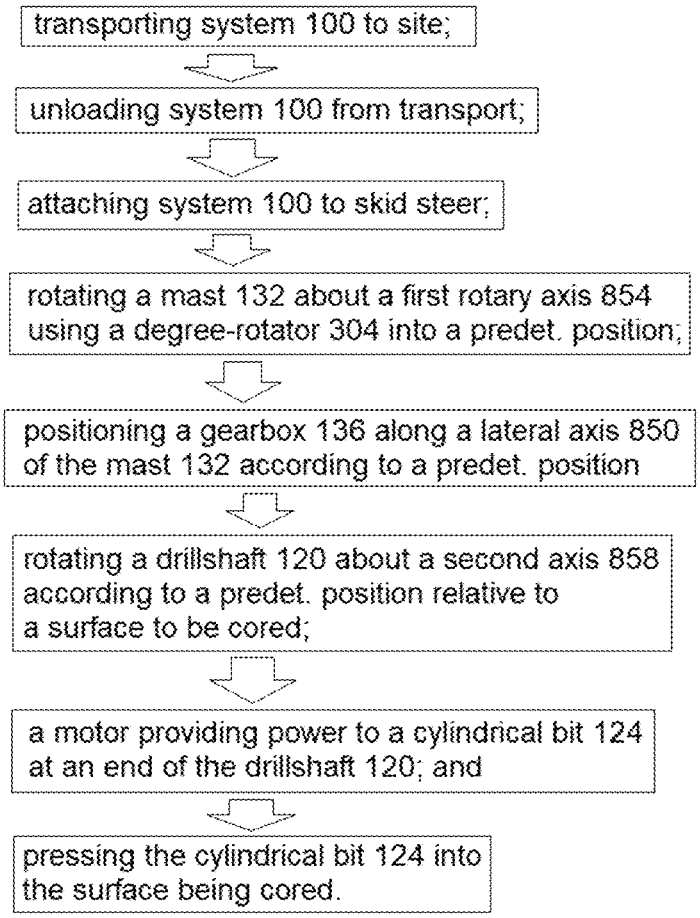
FIG. 12 is a flowchart showing how to operate the system.

FIG. 12 is a flowchart showing how to operate the system 100.

DISCLAIMER

While preferred embodiments of the present invention have been shown and described herein, it will be obvious to those skilled in the art that such embodiments are provided by way of example only. It is not intended that the invention be limited by the specific examples provided within the specification. While the invention has been described with reference to the aforementioned specification, the descriptions and illustrations of the embodiments herein are not meant to be construed in a limiting sense. Numerous variations, changes, and substitutions will now occur to those skilled in the art without departing from the invention. Furthermore, it shall be understood that all aspects of the invention are not limited to the specific depictions, configurations, or relative proportions set forth herein which depend upon a variety of conditions and variables. It should be understood that various alternatives to the embodiments of the invention described herein may be employed in practicing the invention. It is therefore contemplated that the invention shall also cover any such alternatives, modifications, variations, or equivalents. It is intended that the following claims define the scope of the invention and that methods and structures within the scope of these claims and their equivalents be covered thereby.

What is claimed is:

1. A method of manufacturing a coring system, comprising:

connecting a chassis to a skid-steer through an attachment plate;

securing a mast to the chassis using a hinged receptacle;

connecting a drillshaft to the mast using a rotating brace;

connecting a cylindrical bit to the drillshaft at a penetrating end of the drillshaft;

locating a hydraulic motor on a distal end of the drillshaft, opposite the penetrating end;

connecting the hydraulic motor to the drillshaft so as to facilitate rotational operation of the drillshaft;

configuring the rotating brace to accommodate vertical drilling, horizontal drilling, and a plurality of angles between vertical and horizontal;

configuring the degree-rotator for rotating the mast up to 180 degrees about a first rotary axis;

configuring the degree-rotator to allow the system to pivot the cylindrical bit to a predetermined position and then remain in a fixed, stationary position;

configuring a locking hinge and receptacle for preventing the degree-rotator from slipping, and ensuring remaining in position;

locating a spacer between the mast and the drillshaft; and connecting the spacer to a rotating brace which in turn is connected to the drillshaft.

2. The method of claim 1, further comprising:

positioning a gearbox within the mast, suitable for positioning the spacer and rotating brace at a plurality of positions along a lateral axis of the mast.

3. The method of claim 2, further comprising:

arrange the rotating brace to facilitate rotating the drillshaft about a second rotary axis.

4. The method of claim 3, further comprising:

the second rotary axis being transverse to the first rotary axis.

5. The method of claim 1, further comprising:

providing a water connection from a water supply to the drillshaft and cylindrical bit for water-cooling the cylindrical bit as it heats up during operation.

6. The method of claim 1, further comprising:

incorporating a speed selector into the hydraulic motor; and incorporating a transmission, reverse-selection, and wireless sensor module into the hydraulic motor.

7. The method of claim 6, further comprising:

the wireless sensor module communicating information about toque, temperature and direction to a mobile app.

8. The method of claim 6, further comprising:

configuring the speed selector for controlling the speed and direction of rotation of the drillshaft and bit.

9. The method of claim 1, further comprising:

configuring the system for providing self-contained water within the chassis; and configuring the system with a plurality of quick-connect ports for hydraulic power, air, or water from an external source.

10. The method of claim 9, further comprising:

configuring the self-contained water to have the water pump built into the chassis.

11. The method of claim 9, further comprising:

configuring a three-pad landing arrangement within the chassis, where each of the pads comprise a boot and a cushion where the boots can be adjusted up and down.

12. The method of claim 1, further comprising:

equipping the skid-steer to transport the system; and equipping the skid-steer to provide hydraulic power.

13. The method of claim 1, further comprising:

attaching hydraulic lines from a hydraulic power source to the hydraulic motor; and utilizing the skid-steer as the hydraulic power source.

14. The method of claim 1, further comprising:

configuring a mast-adjustor for advancing the gearbox along a longitudinal axis of the mast.

15. The method of claim 1, further comprising:

configuring the system such that during storage or transport, the mast is put into a vertical-only position using the degree-rotator, and then stored or moved.

16. The method of claim 1, further comprising:

diamond-impregnating a plurality of teeth located within the cylindrical bit.

17. A method of manufacturing a coring system, comprising:

connecting a chassis to a skid-steer through an attachment plate;

securing a mast to the chassis using a hinged receptacle;

connecting a drillshaft to the mast using a rotating brace;

connecting a cylindrical bit to the drillshaft at a penetrating end of the drillshaft;

locating a hydraulic motor on a distal end of the drillshaft, opposite the penetrating end;

connecting the hydraulic motor to the drillshaft so as to facilitate rotational operation of the drillshaft;

configuring the rotating brace to accommodate vertical drilling, horizontal drilling, and a plurality of angles between vertical and horizontal;

configuring the system for providing self-contained water within the chassis;

configuring the system with a plurality of quick-connect ports for hydraulic power, air, or water from an external source;

configuring the self-contained water to have the water pump built into the chassis; and configuring a three-pad landing arrangement within the chassis, where each of the pads comprise a boot and a cushion where the boots can be adjusted up and down.

* * * * *